US006305354B1

(12) United States Patent
Kato

(10) Patent No.: US 6,305,354 B1
(45) Date of Patent: Oct. 23, 2001

(54) ENGINE INJECTION SYSTEM

(75) Inventor: Masahiko Kato, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 234 days.

(21) Appl. No.: 08/656,106

(22) Filed: May 31, 1996

(30) Foreign Application Priority Data

May 31, 1995 (JP) ..... 7-134334

(51) Int. Cl.[7] ..... F02M 37/04
(52) U.S. Cl. ..... 123/456; 123/467
(58) Field of Search ..... 123/456, 451, 123/467, 468, 469, 470

(56) References Cited

U.S. PATENT DOCUMENTS 3,507,263 * 4/1970 Long ..... 123/456
4,777,921 * 10/1988 Miyaki et al. ..... 123/456
5,186,138 * 2/1993 Hashimoto ..... 123/198 DB
5,411,001 * 5/1995 Werner ..... 123/456
5,447,139 * 9/1995 Yonekawa ..... 123/456
5,509,391 * 4/1996 DeGroot ..... 123/456
5,577,477 * 11/1996 Katoh ..... 123/456
5,595,160 * 1/1997 Matsumoto ..... 123/456

* cited by examiner

*Primary Examiner*—Carl S. Miller
(74) *Attorney, Agent, or Firm*—Ernest A. Beutler

(57) ABSTRACT

An engine fuel injection system including a supply arrangement that includes a pair of conduits for supplying fuel to the plural injectors. The conduits are interrelated with the injectors in such a way that no one conduit supplies fuel to any two fuel injectors that fire simultaneously with or in sequence with each other.

25 Claims, 8 Drawing Sheets

ENGINE INJECTION SYSTEM

BACKGROUND OF THE INVENTION

This invention relates to an engine injection system and more particularly to an improved fuel supply arrangement for supplying the fuel to the injectors of a multi-cylinder engine.

The use of fuel injection for operating internal combustion engines and to provide the charge-forming system for such engines is being resorted to for a variety of reasons. Not the least of these is the possibility of improved fuel economy and also of better exhaust emission control. However, in some regards the fuel injection system is more complicated than other forms of charge-forming systems and particularly where multiple cylinder engines are involved.

With multiple cylinder engines, it is generally the practice to try to position the fuel injectors so they are all in an in-line relationship. With V-type engines, the fuel injectors associated with the individual cylinder banks are aligned with each other in a common type of construction. However, this generally means that the fuel is supplied to all of the aligned injectors through a common fuel rail.

A difficulty with such an arrangement is that at times the fuel injectors of adjacent firing cylinders may have overlap in their time periods of injection or they may be closely spaced so that the injection of fuel from one injector can adversely affect the amount of fuel injected from the next firing injector.

This problem can be best understood by reference to FIG. 1 which is a graphical timing diagram showing a complete revolution of a six-cylinder, even firing, internal combustion engine operating on a two-stroke principal and having fuel injection. The timing of firing of the individual spark plugs is shown as is the duration of fuel injection under a high-load/high-speed condition. It will be seen that although the cylinders are set so as to fire at equal intervals. 60° from each other the long duration of fuel injection causes some overlap in injection between adjacent firing cylinders.

If a common fuel rail supplies fuel to these adjacent firing cylinders, then, even though the pressure is regulated, there may be a drop off in the amount of fuel injected during the overlap period. This cylinder-to-cylinder variation may also occur even if there is no overlap if the timing of injections are close to each other as the pulses in the fuel rail may also have a similar effect. Also this makes simultaneous injection periods undesirable.

It is, therefore, a principal object of this invention to provide an improved fuel injection system for a multi cylinder engine.

It is a further object of the invention to provide an improved multi cylinder fuel injection system and fuel supply arrangement therefor so that uniform fuel injection can be enjoyed under all engine running conditions.

SUMMARY OF THE INVENTION

This invention is adapted to be embodied in an engine injection system comprised of a plurality of fuel injectors. Means are provided for operating the fuel injectors for spraying the fuel therefrom in an ordered sequence. Means are provided for delivering fuel from a fuel source to the fuel injectors and this includes at least two separate fuel supply conduits. Each of these conduits is related to the fuel injectors so that neither conduit delivers fuel to fuel injectors which fire in adjacent sequence to or simultaneously with each other.

DETAILED DESCRIPTION OF THE PREFERRED EMBODIMENTS OF THE INVENTION

Figure 1:
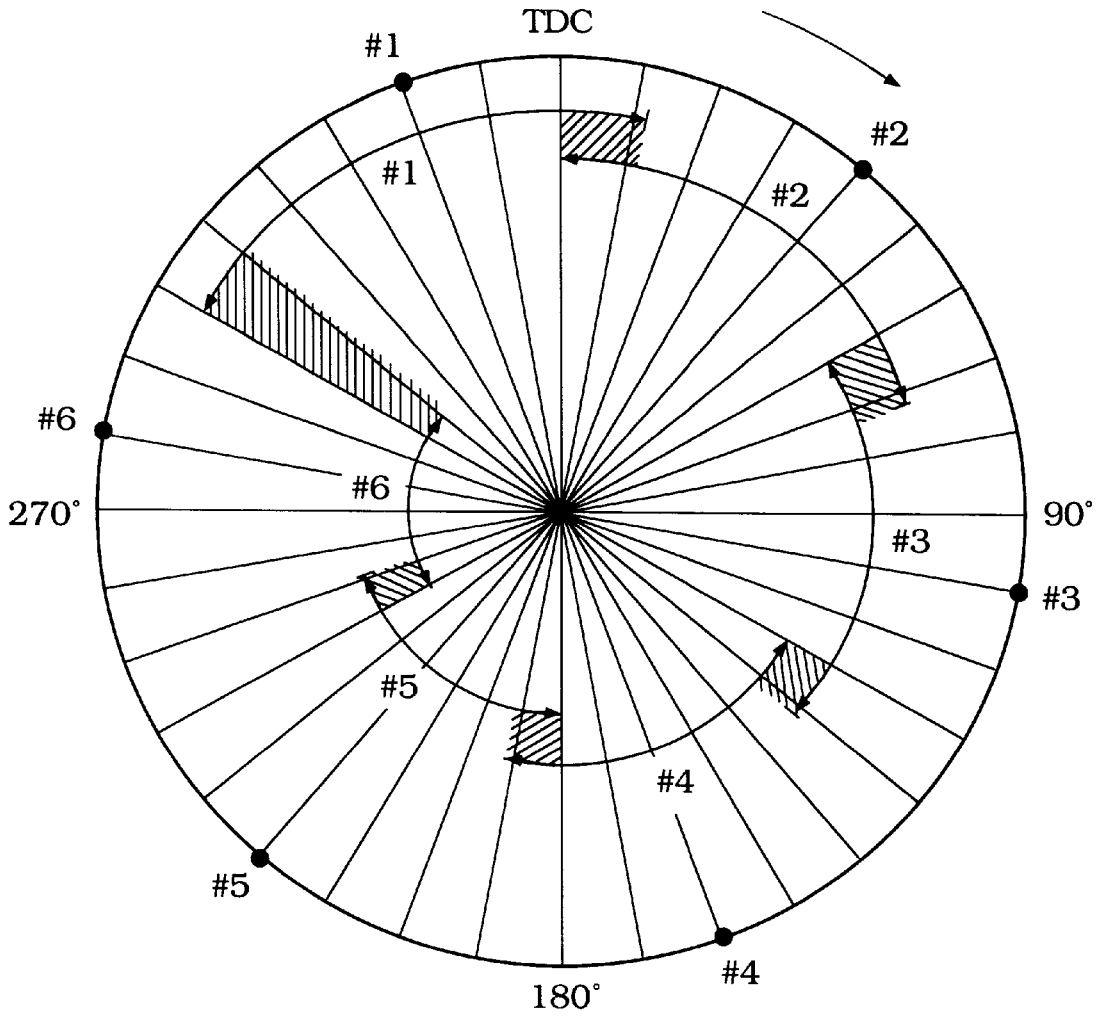
Figure 1 Prior Art
FIG. 1 is a graphical timing diagram of the fuel injection and spark firing of a six-cylinder, two-cycle, even firing integral engine.
Figure 2:
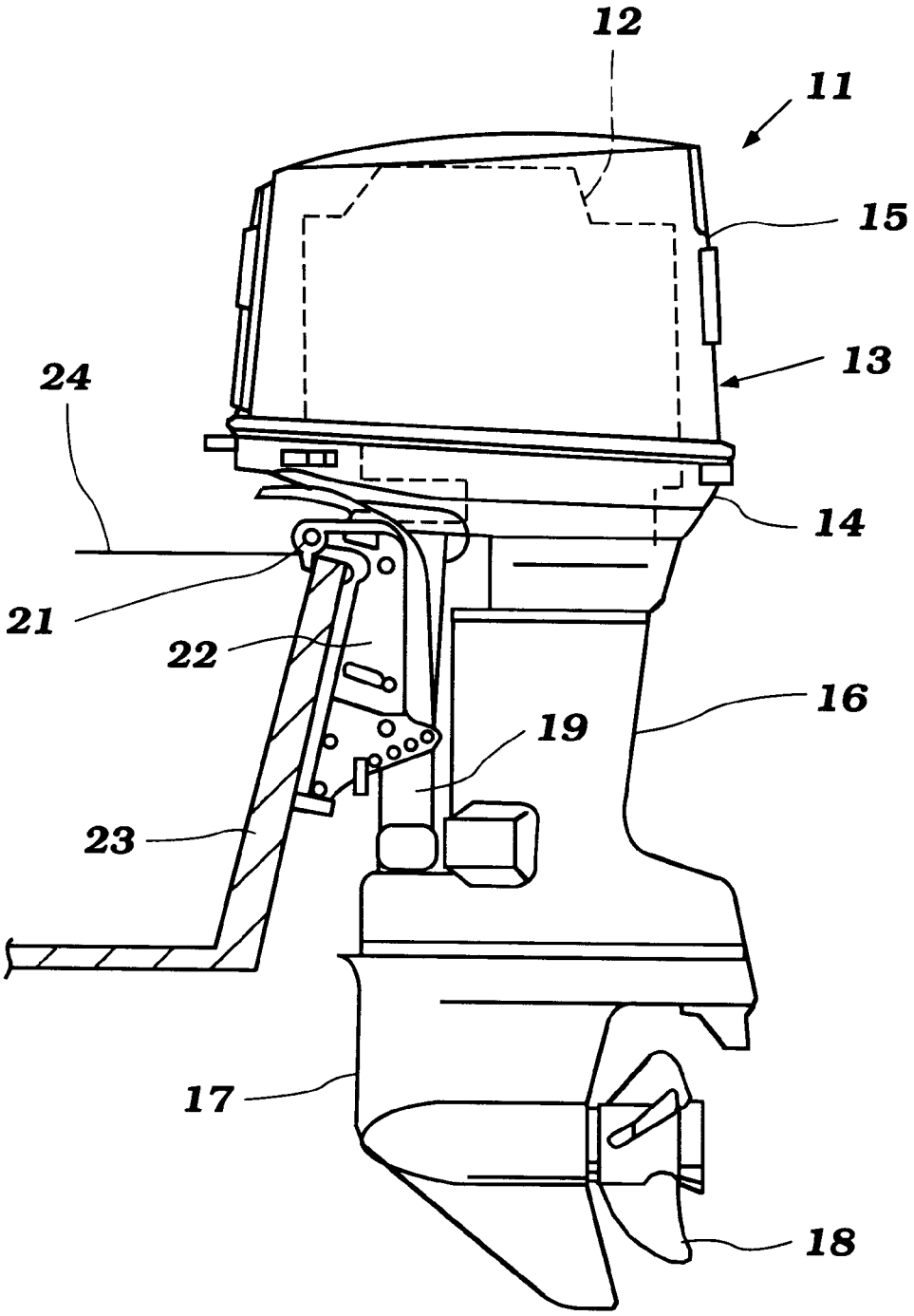
FIG. 2 is a side elevational view of an outboard motor constructed in accordance with an embodiment of the invention.

Referring first to FIG. 2, an outboard motor constructed and operated in accordance with an embodiment of the invention is identified generally by the reference numeral 11. The invention is described in conjunction with an outboard motor such as the outboard motor 11 because it has particular utility to two-cycle engines. The application of the invention to an outboard motor such as the outboard motor 11 has been chosen for illustration purposes because two-cycle engines normally form the power plant for such outboard motor.

The reason the invention has particular utility with two-cycle engines is because of the fact that every cylinder fires every rotation of the crankshaft and the aforenoted problem is more likely to occur with a two-cycle engine than with a four-cycle engine. While the invention has particular utility with two-cycle engines, the inventive concept may also be applied to four-cycle engines. In addition to being susceptible of use also with outboard motors, the invention also may be utilized with a wide variety of other applications for engines.

The outboard motor 11 includes a power head that is comprised of a powering internal combustion engine, indicated generally by the reference numeral 12 and which is surrounded by a protective cowling, indicated generally by the reference numeral 13. The cowling 13 is comprised of a lower tray portion 14 and an upper, detachable main cowling portion 15.

As will become apparent by reference to the later figures, the engine 12 is mounted in the power head 13 so that an output shaft rotates about a vertically extending axis. This orientation facilitates coupling to a drive shaft (not shown) that depends into and is rotatably jounaled within a drive shaft housing 16. Beneath the drive shaft housing 16 is positioned a lower unit 17 where the aforenoted drive shaft drives a propeller 18 mounted on a propeller shaft which is driven through a forward, neutral, reverse transmission contained in the lower unit 17.

The drive shaft housing has affixed to it a steering shaft (not shown). This steering shaft is journaled in a swivel bracket 19 for steering of the outboard motor 11 about a generally vertically extending axis. The swivel bracket 19 is, in turn, pivotally connected by a pivot pin 21 to clamping bracket 22. The pivotal connection provided by the pivot pin 21 permits tilt and trim movement of the outboard motor 11. The clamping bracket is, in turn, connected to a transom 23 of a watercraft shown partially and indicated by the reference numeral 24 in a known manner.

As aforenoted, the invention is directed to the engine 12 and specifically its fuel injection system and thus where any details of the outboard motor 11 have not been described or illustrated, they may be considered to be conventional.

Figure 3:
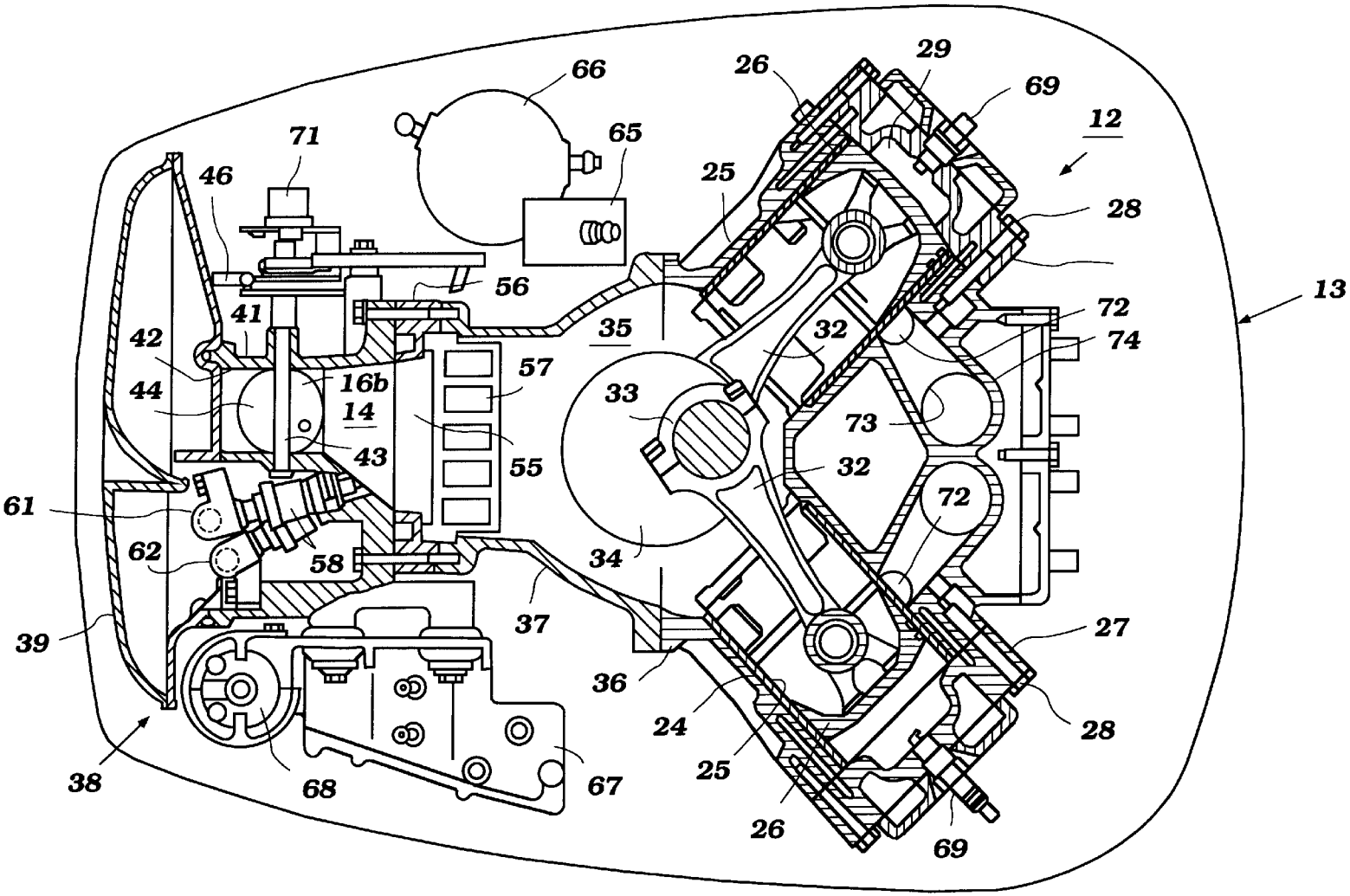
FIG. 3 is a top plan view of the power head of the outboard motor with only the outline of the protective cowling shown and with the engine shown in a cross-sectional view.

Referring now primarily to FIG. 3, it will be seen that the engine 12 is comprised of a cylinder block 24 having a plurality of cylinder bores 25 in which respective pistons 26 are supported for reciprocation. In the illustrated embodiment, the engine 12 is depicted as being of the V-6 type. Accordingly, the cylinder block 24 is divided into a pair of angularly disposed cylinder banks each of which is provided with three cylinder bores 25. As is typical with V-type engine practice, the cylinder bores 25 of the cylinder banks may be staggered slightly with respect to each other. Although the invention is described in conjunction with a V-6 type engine, it will be readily apparent to those skilled in the art how the invention can be employed with engines having other cylinder members and other cylinder configurations.

It will also be understood by those skilled in the art from the following description that the invention has particular utility in conjunction with engines having multiple fuel injectors which are all generally aligned with each other so that the aforenoted problem regarding overlapping of injection cycles and possible variations in fuel injection amounts may be possible.

Continuing to refer to FIG. 3, each cylinder bank formed in the cylinder block 23 is closed by a respective cylinder head assembly 27. The cylinder head assemblies 27 arc affixed to the cylinder block 24 in any suitable manner such as by the fasteners 28 which appear in this figure.

Each cylinder head is provided with a plurality of recesses 29 which cooperate with the pistons 26 and cylinder bores 25 so as to form the combustion chambers of the engine. Since, at top dead center, the substantial portion of the clearance volume is formed by the piston recesses 29, these numbers will occasionally be referred to as identifying the combustion chambers.

Each piston 26 is pivotally connected by means of a piston pin 31 with the upper or small end of a connecting rod 32. The big ends of the connecting rods 32 are journaled upon respective throws 33 of a crankshaft 34. The crankshaft 34 is rotatably journaled within a crankcase chamber 35. The crankcase chamber 35 is formed by a skirt 36 of the cylinder block 24 and a crankcase member 37 that is affixed to the skirt 36 in any known manner. As is typical with two-cycle engine practice, the crankcase chambers 35 associated with each of the cylinder bores 25 are sealed from each other.

An induction and charge-forming system, indicated generally by the reference numeral 38 is provided for supplying a fuel air charge to these crankcase chambers 37. This system includes an air inlet device 39 which has inlet openings (not shown) that draw air from within the protective cowling 13. As is known in this art, the cowling 13 is provided with an atmospheric air inlet so that atmospheric air for engine combustion can be drawn into it. The inlet device 39 may also be configured so as to provide silencing for the inducted air charge.

Figure 5:
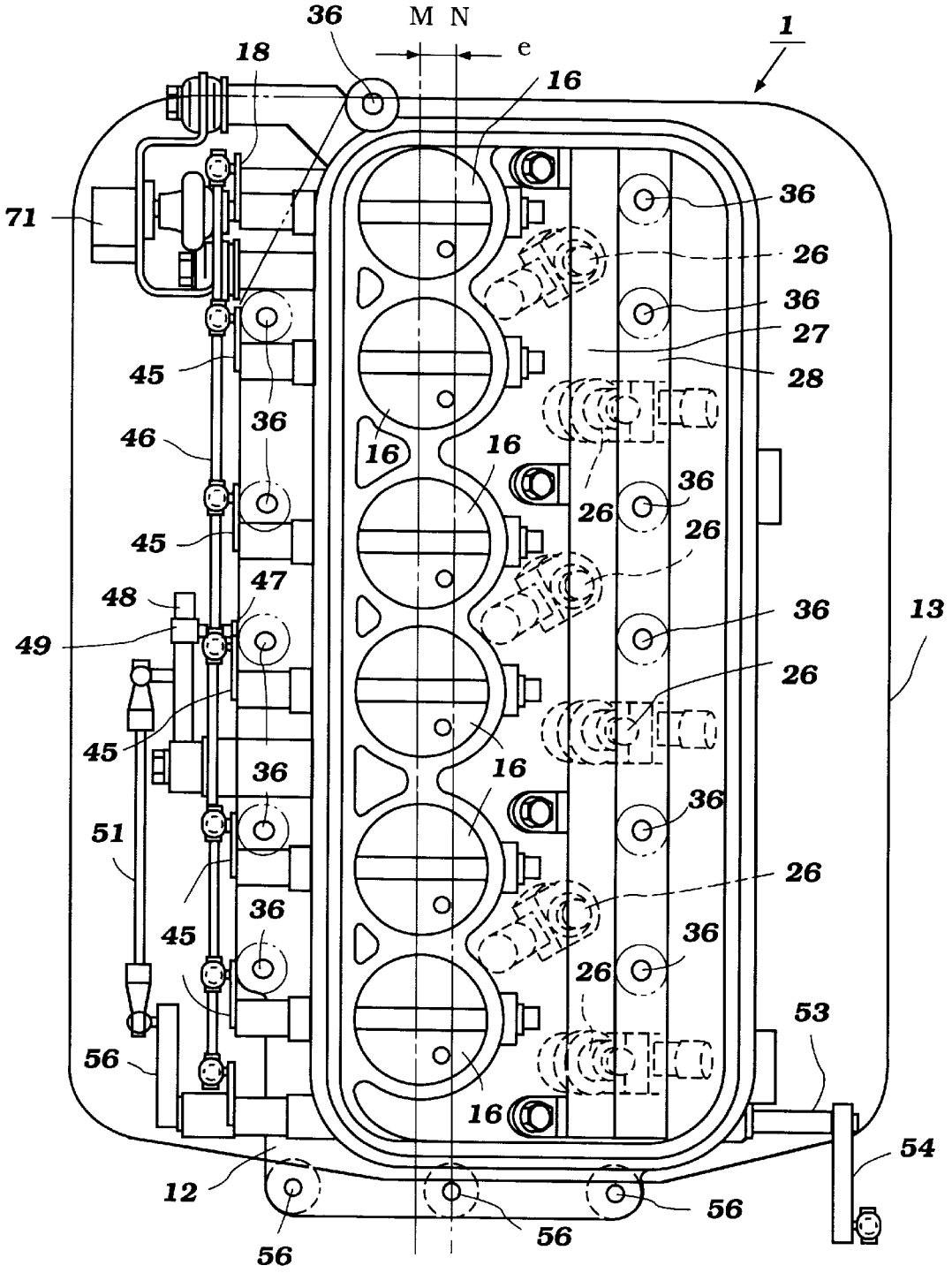
FIG. 5 is an enlarged end elevational view showing the throttle body mechanism with the cover plate removed and looking generally in the direction of the arrow 5 in FIG. 4.

The air inlet device 39 delivers air that has been inducted into a throttle body assembly, indicated generally by the reference numeral 41 and having a plurality of induction passages 42 each of which is aligned with a respective one of the crankcase chambers 35. Each induction passage 42 is configured, however, so that its center line, lying on the line M shown in FIG. 5 is offset from the center line N which is the center of the crankcase chambers 35 by a distance e. The reason for this offsetting will be described later.

The throttle body 41 rotatably journals at a plurality of throttle valve shafts 43 upon which butterfly-type throttle valves 44 are fixed. On one side of the engine, each throttle valve shaft 45 is provided with a throttle lever 45 (see also FIG. 5) which is connected to a synchronizing linkage system 46 so that all of the throttle valve shafts 43 will be rotated in unison. One of the throttle valve shafts 43 has a unique throttle lever 45, indicated at 47 in FIG. 5 so as to afford connection to a throttle valve actuator 48.

The throttle valve actuator 48 carries an adjustable connection 49 so as to change the effective timing between it and the unique throttle link 47. A main throttle actuator 51 is connected to the throttle actuator 48 at one end and to an operating lever 52 at the other end. The operating lever 52 is affixed on an elongated shaft 53. At the opposite end of the shaft, there is provided a connector 54 for connection to a remote throttle operating mechanism.

The throttle body 41 is connected to an intake manifold 55 which is affixed to the crankcase member 37 by means of threaded fasteners 56. It will be seen that manifold openings 60 are fed by offset portions of the throttle body 41 downstream of the intake passages 42 so as to deliver the charge substantially across the width of each crankcase chamber 35.

As is well known in this art, read-type check valves 57 are provided in each of the manifold openings 60 so as to permit the flow of charge into the crankcase chambers 35 and the pistons 26 are moving upwardly in the cylinder bores 25. The reed-type valves 57 will close when the pistons move downwardly to compress the charge therein.

The thus compressed charge is then transferred to the combustion chambers 29 through one or more scavenge passages (not shown).

Figure 4:
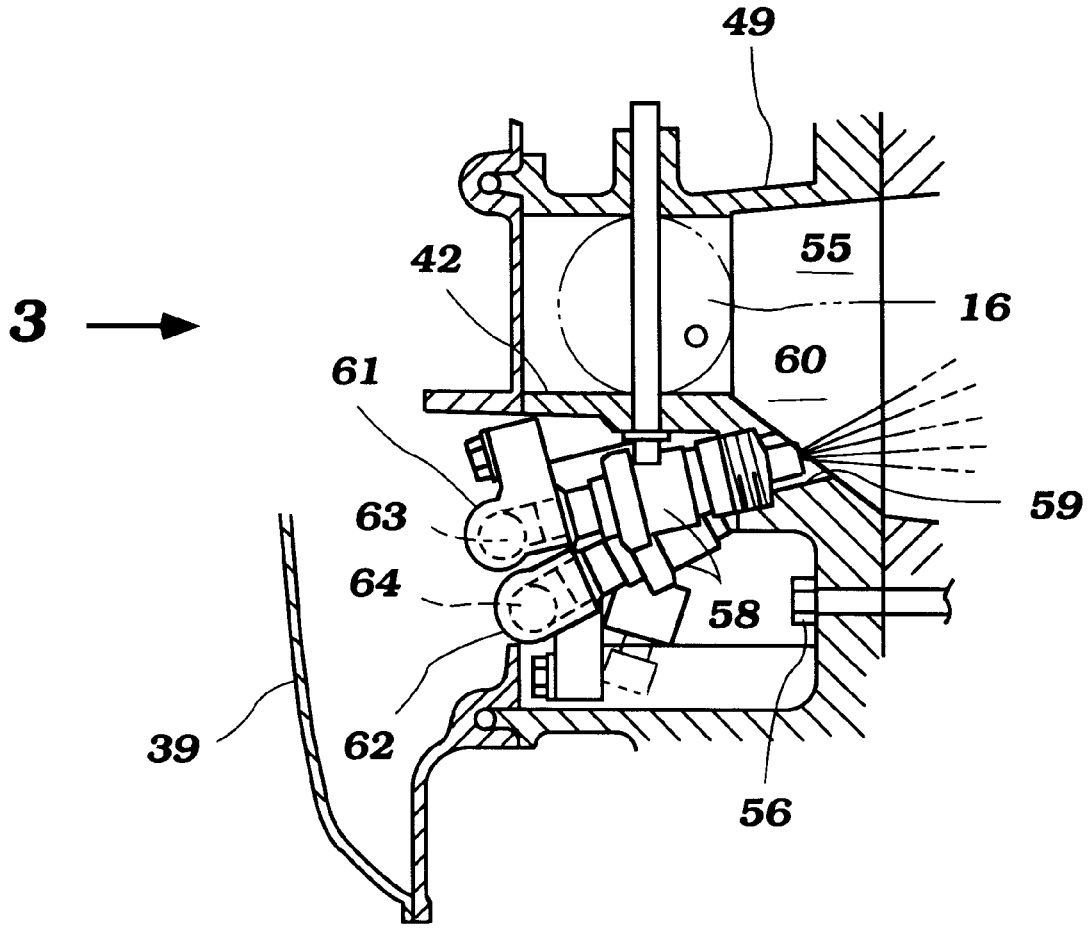
FIG. 4 is a cross-sectional view looking in the same direction as FIG. 3 but on an enlarged scale.

Fuel is mixed with the inducted air charge by means of fuel injectors, indicated generally by the reference numeral 58. It will be seen from FIG. 4 that the fuel injectors 58 are generally aligned but are skewed slightly relative to each other for a reason which will become apparent.

The fuel injectors 58 are mounted in mounting ports 59 in the throttle body 41 so that they spray into the passages 55 downstream of the throttle valve 44. The aforenoted offsetting of the center of the throttle body passages 42 permits the fuel injectors to be positioned so that their spray axis is generally parallel to the manifold intake passages 60 and the center of the reed-type check valves 57. This ensures uniform fuel distribution.

The fuel injector 58 may be of the electrically-operated type. That is, they are provided with a solenoid operated pintle valve to control the opening and closing of discharge nozzle ports which in turn spray into the manifold passages as aforedescribed. Since the actual construction of the fuel injectors 58 forms no part of the invention, except for their orientation and the way in which fuel is supplied to them, a further description of their construction is not believed to be necessary to permit those skilled in the art to practice the invention.

In accordance with the invention, the injectors 58 are supplied with fuel from, in this embodiment, a pair of parallel-extending fuel rails 61 and 62 each of which has an internal distribution passage 63 and 64. The fuel rails 61 and 62 are affixed to the injection nozzles 58 so as to supply fuel thereto. In accordance with the invention, the manifold arrangement provided by the fuel rail 61 and 62 is such that neither fuel rail 61 nor 62 supplies fuel to two injectors which fire in immediate sequence from each other. As will be described, this can be accomplished even if two of the fuel injectors inject simultaneously if the fuel rail 61 and 62 are positioned as aforedescribed so that neither supplies the injector that fires adjacent or simultaneously with another.

Fuel is supplied to the fuel rails 61 and 62 by a fuel supply system that includes a remotely positioned fuel tank which is preferably located within the hull of the watercraft 24. This fuel is delivered through a quick disconnect connector (not shown) to a low-pressure fuel pump 65 that is mounted in the protective cowling 13 on the side of the engine 12 opposite the injectors 58. Fuel is drawn by the fuel pump 65 through a fuel filter 66 which is in direct connection with the aforenoted disconnect coupling to the external fuel tank.

Fuel is then transferred from the low-pressure fuel pump 65 to a vapor separator assembly 67 that is mounted in the protective cowling 14 on the side adjacent the fuel injectors 58. This vapor separator 67 may include a high-pressure fuel pump 68 which then supplies fuel to the fuel rails 61 and 62. A pressure regulator may also be provided so as to regulate the pressure so that equal pressure is delivered to each fuel rail passage 63 and 64.

The fuel/air charge thus formed is, as aforenoted, delivered to the combustion chambers 29 through the engine scavenging system. This charge is then fired by means of spark plugs 69 that are mounted in the cylinder head assemblies 27. These spark plugs 69 are fired under the control of an ECU and ignition system (not shown).

The entire engine system may be managed by such an ECU and it is provided with various signals of engine operation and ambient conditions for the control strategy. This may include a throttle position signal indicated by a throttle position sensor 71 that is mounted on the engine and which cooperates with one of the throttle valve shafts 43 in a well-known manner. Since the control strategy forms no part of the invention, further description of it is not believed to be necessary to permit those skilled in the art to practice the invention.

The charge which is ignited will burn and expand and drive the pistons 26 downwardly in the cylinder bores 25. Eventually, exhaust ports 72 formed in the sides of the cylinder block 24 will be opened and the exhaust gases can flow into an exhaust manifold 73 formed in the valley between the cylinder banks by means of an exhaust collector assembly, indicated generally by the reference numeral 74. These exhaust gases are then discharged to the atmosphere through any known type of exhaust system which may include a through-the-hub, high-speed, underwater exhaust discharge.

In the embodiment of the invention as thus far described, the manifold system and fuel rail passages 63 and 64 have been formed in separate fuel rail bodies. Next will be described a pair of embodiments wherein a single fuel rail body forms two integral fuel rails comprised of two fuel rail passages 63 and 64.

Figure 7:
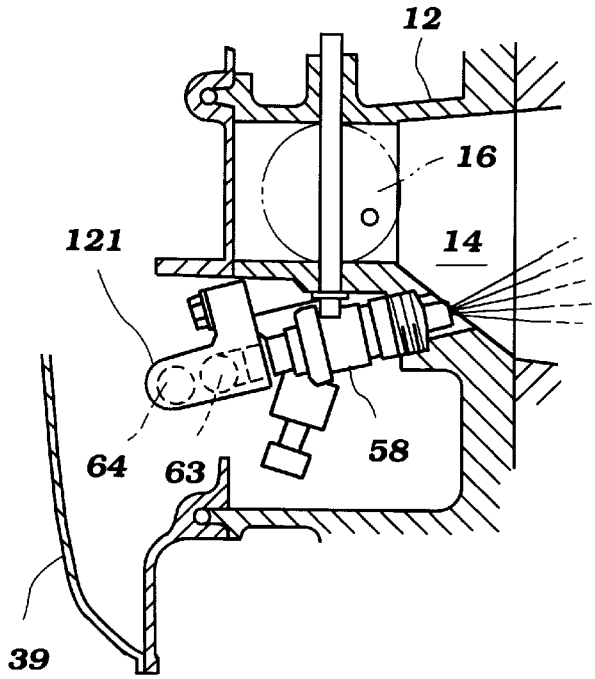
FIG. 7 is a cross-sectional view, in part similar to FIGS. 4 and 6, and shows a still further embodiment of the invention.

The first of these embodiments appears in FIG. 7 wherein there is provided a compound fuel rail body, indicated generally by the reference numeral 101 that is provided with the conduits 63 and 64 that supply the respective fuel injectors 58. Aside from the fact that the heretofore separate fuel rail bodies are formed in a single compound fuel rail this embodiment and the injector location is the same as that previously described and further description is not believed to be necessary to permit those skilled in the art to practice the invention.

Figure 6:
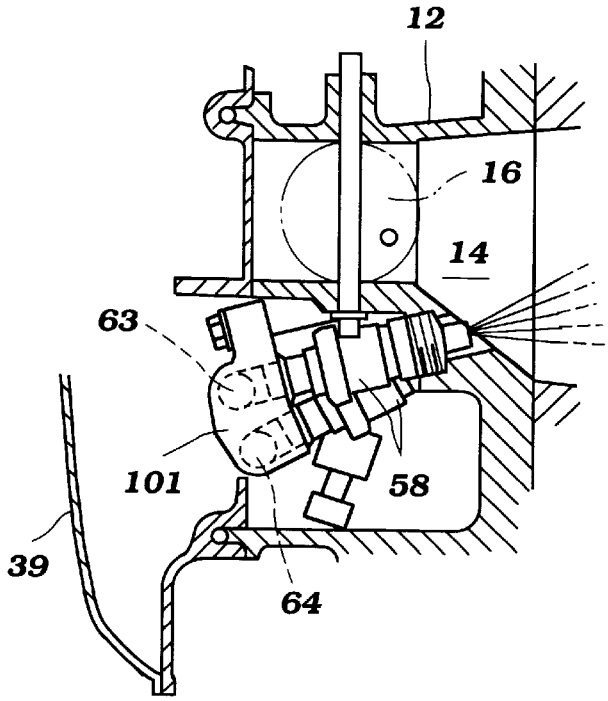
FIG. 6 is an enlarged cross-sectional view, in part similar to FIG. 4 and shows another embodiment of the invention.

FIG. 7 shows another compound assembly that permits the use of injectors that are not skewed relative to each other. With this embodiment, the injectors 58 are all in a vertical line and are supplied by respective fuel passages 63 and 64 that are formed in parallel side-by-side relationship within a main compound manifold fuel rail 121. The fuel rail 121 has supply passages that serve the respective injectors 58. As should be apparent, the embodiments of FIGS. 6, 7, and 8 provide a somewhat more compact assembly while still obtaining the same benefits of the first described embodiment.

Figure 8:
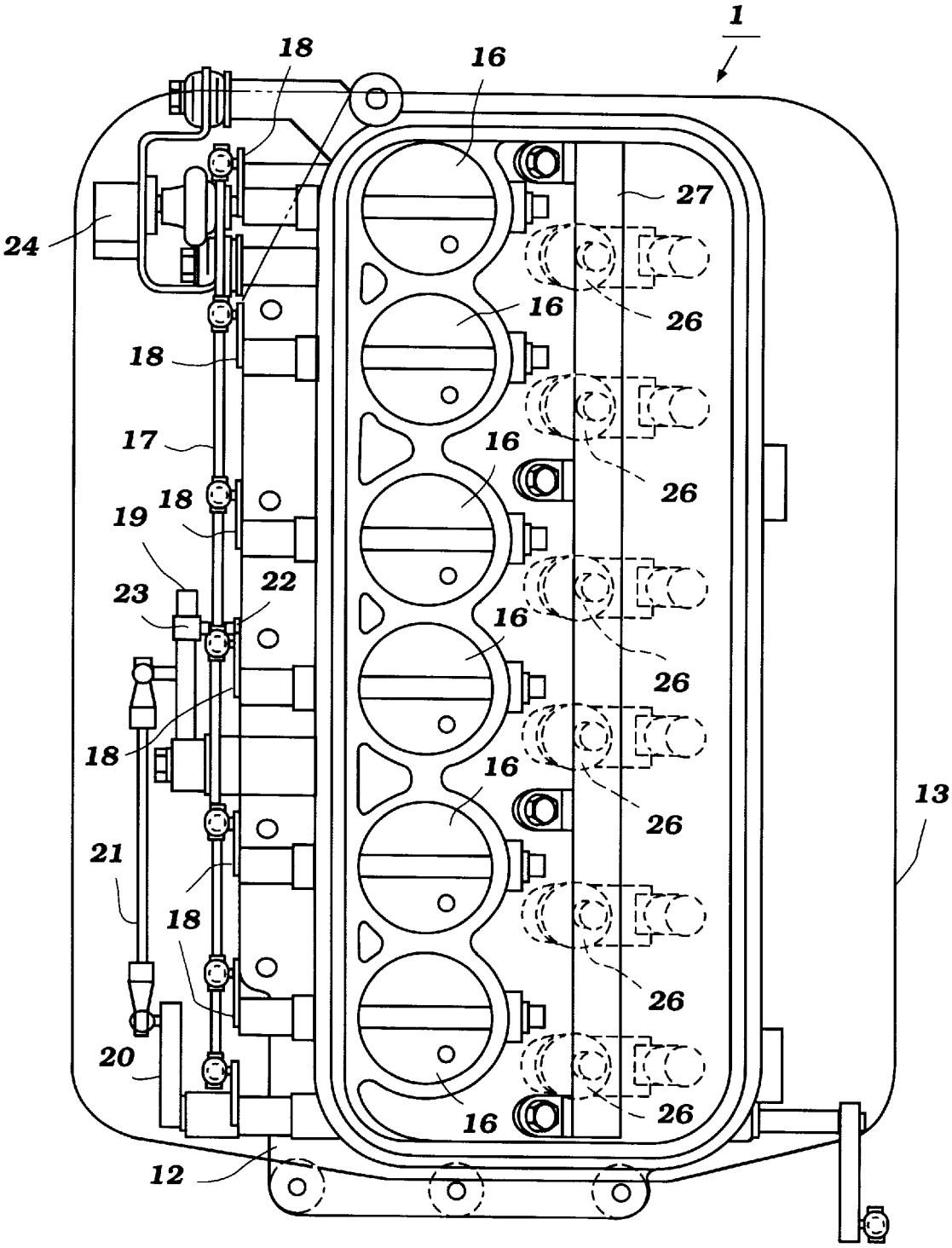
FIG. 8 is an end elevational view, in part similar to FIG. 5, but shows the corresponding view of the embodiment of FIG. 7.
Figure 9:
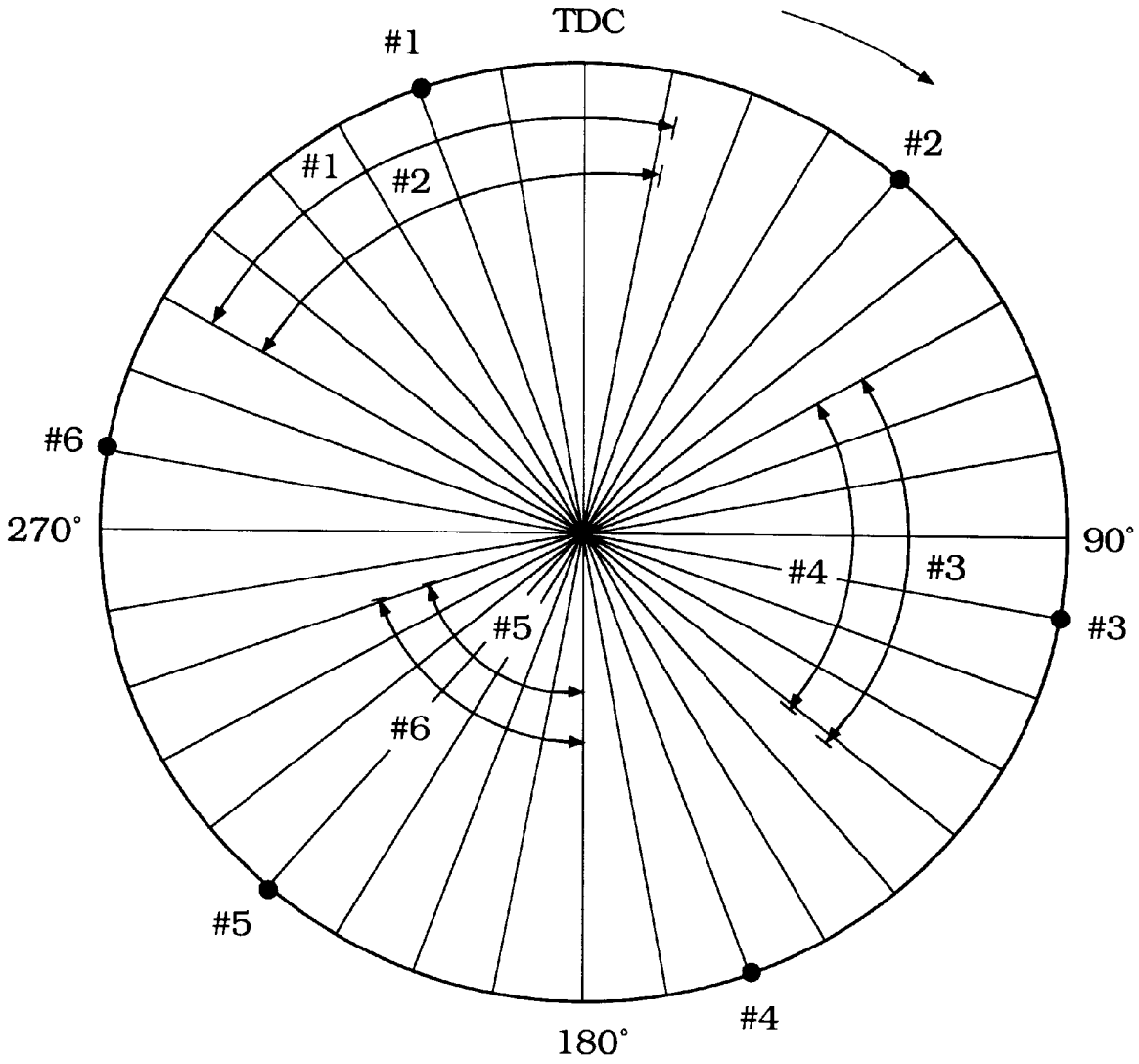
FIG. 9 is a timing diagram showing another way in which the improved fuel injection can be employed utilizing a change in fuel injection timing.

FIG. 9 is a timing diagram, in part similar to FIG. 8 and shows another way in which the system may be operated so as to avoid adverse effects of firing of the fuel injectors and will in fact permit the injectors to be fired simultaneously even though the respective cylinder spark plugs are fired in sequence.

As may be seen in FIG. 9, which represents a high-load/high-speed condition, the injector for cylinder 1 injects at a time period when cylinder 1 is firing. Actually, the injection occurs before the actual timing of firing on the preceding cycle. The injector for cylinder 2 injects later but still before the spark plug associated with this cylinder is fired. Hence, the injectors may inject simultaneously but because of the separate fuel rail manifolding arrangement there will be no adverse effects of one injector on the other.

In addition to the described embodiments, it should be readily apparent to those skilled in the art that other embodiments of the invention are possible without departing from the spirit and scope of the invention, as defined by the appended claims.

What is claimed is:

1. An engine induction system for an engine provided with a multiple number of cylinders formed in angularly disposed cylinder banks each having at least two cylinders, said engine induction system being comprised of a plurality of fuel injectors all disposed in a row and each of which serves a respective one of said cylinders, said fuel injectors all injecting into a common throttle body from one side thereof, means for operating said fuel injectors for spraying fuel therefrom in sequence, and means for delivering fuel from a source to said fuel injectors comprised of at least two separate fuel supply conduits, each conduit being related to said fuel injectors so that fuel is not supplied by any conduit to two fuel injectors that inject adjacent to or simultaneous with each other.

2. An engine induction system as set forth in claim 1, wherein the injectors are staggered slightly relative to each other.

3. An engine induction system as set forth in claim 2, wherein the fuel rails extend parallel to each other.

4. An engine induction system as set forth in claim 1, wherein the conduits are formed in a common fuel rail.

5. An engine induction system as set forth in claim 4, wherein the conduits are disposed in side-by-side relationship.

6. An engine induction system as set forth in claim 4, wherein the conduits are disposed one above the other.

7. An engine induction system comprised of a plurality of fuel injectors, means for operating said fuel injectors for spraying fuel therefrom in sequence, and means for delivering fuel from a source to said fuel injectors comprised of at least two separate fuel supply conduits each of which supplies fuel from respective separate discharge ports to at least two fuel injectors, each conduit being related to said fuel injectors so that fuel is not supplied by any conduit to two fuel injectors that inject adjacent to or simultaneous with each other.

8. An engine induction system as set forth in claim 7, wherein the fuel injectors are all aligned substantially in a row.

9. An engine induction system as set forth in claim 8, wherein the separate fuel supply conduits separate respective discharge ports are formed in separate fuel rails.

10. An engine induction system as set forth in claim 9, wherein the injectors are staggered slightly relative to each other.

11. An engine induction system as set forth in claim 10, wherein the fuel rails extend parallel to each other.

12. An engine induction system as set forth in claim 8, wherein the conduits are formed in a common fuel rail.

13. An engine induction system as set forth in claim 12, wherein the conduits are disposed in side-by-side relationship.

14. An engine induction system as set forth in claim 12, wherein the conduits are disposed one above the other.

15. An engine induction system as set forth in claim 7, wherein the engine is provided with a multiple number of cylinders.

16. An engine induction system as set forth in claim 15, wherein each of the fuel injectors serves a respective one of the cylinders.

17. An engine induction system as set forth in claim 16, wherein the cylinders are formed in angularly disposed cylinder banks each having at least two cylinders.

18. An engine induction system as set forth in claim 17, wherein the fuel injectors are all disposed in a row.

19. An engine induction system as set forth in claim 18, wherein the fuel injectors all inject into a common throttle body from one side thereof.

20. An engine induction system as set forth in claim 19, wherein the separate fuel supply conduits are formed in separate fuel rails.

21. An engine induction system as set forth in claim 20, wherein the injectors are staggered slightly relative to each other.

22. An engine induction system as set forth in claim 21, wherein the fuel rails extend parallel to each other.

23. An engine induction system as set forth in claim 19, wherein the conduits are formed in a common fuel rail.

24. An engine induction system as set forth in claim 23, wherein the conduits are disposed in side-by-side relationship.

25. An engine induction system as set forth in claim 23, wherein the conduits are disposed one above the other.

* * * * *